US009333530B2

(12) United States Patent
Burger

(10) Patent No.: US 9,333,530 B2
(45) **Date of Patent: *May 10, 2016**

(54) INSTALLATION FOR PROCESSING A PAPER WEB, IN PARTICULAR A CIGARETTE PAPER WEB

(71) Applicant: DELFORTGROUP AG, Traun (AT)

(72) Inventor: Franz Burger, Pill (AT)

(73) Assignee: delfortgroup AG, Traun (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/487,881

(22) Filed: Sep. 16, 2014

(65) Prior Publication Data

US 2015/0004321 A1 Jan. 1, 2015

Related U.S. Application Data

(63) Continuation of application No. 13/266,504, filed as application No. PCT/EP2010/002665 on Apr. 30, 2010, now Pat. No. 8,863,657.

(30) Foreign Application Priority Data

Apr. 30, 2009 (DE) ..... 10 2009 019 600

(51) Int. Cl.
*B41F 17/00* (2006.01)
*B41F 17/20* (2006.01)
(Continued)

(52) U.S. Cl.
CPC ... *B05D 1/02* (2013.01); *A24C 5/38* (2013.01); *D21F 5/00* (2013.01); *D21F 9/00* (2013.01);
(Continued)

(58) Field of Classification Search
CPC ..... B41F 17/006; B41F 17/30; B41F 17/16; B41F 17/26
USPC ..... 101/35, 284, 219; 131/284; 400/611
See application file for complete search history.

(56) References Cited

U.S. PATENT DOCUMENTS 3,941,902 A 3/1976 Wennerblom
4,265,255 A 5/1981 Helms
(Continued)

FOREIGN PATENT DOCUMENTS

AT 282451 6/1970
CH 518685 2/1972
(Continued)

OTHER PUBLICATIONS

European Patent Office, European Application No. 10719264.3 Communication re Third Party Observations dated Jun. 10, 2013 , 8 pages.
(Continued)

*Primary Examiner* — Matthew G Marini
*Assistant Examiner* — John M Royston
(74) *Attorney, Agent, or Firm* — Dennis J. Williamson; Moore & Van Allen PLLC

(57) ABSTRACT

An arrangement for processing a paper web having a low surface area density not exceeding 70 g/m$^2$, in particular a cigarette paper web, that may include in a conveyance direction: an input side, over which the paper web is fed into the arrangement; an output side, over which the paper web leaves the arrangement; a device downstream of the input side, in particular a printing unit, preferably a gravure printing unit, for applying a liquid printing medium to the paper web; a first drying station following the applying station in direction of conveyance, in particular hot-air drying, for drying the printing medium applied to the paper web; a device following the first drying in direction of conveyance for moistening the paper web and a second drying station following the moistening device in direction of conveyance, by which the moistened paper web is dried.

20 Claims, 3 Drawing Sheets

Figure 1:
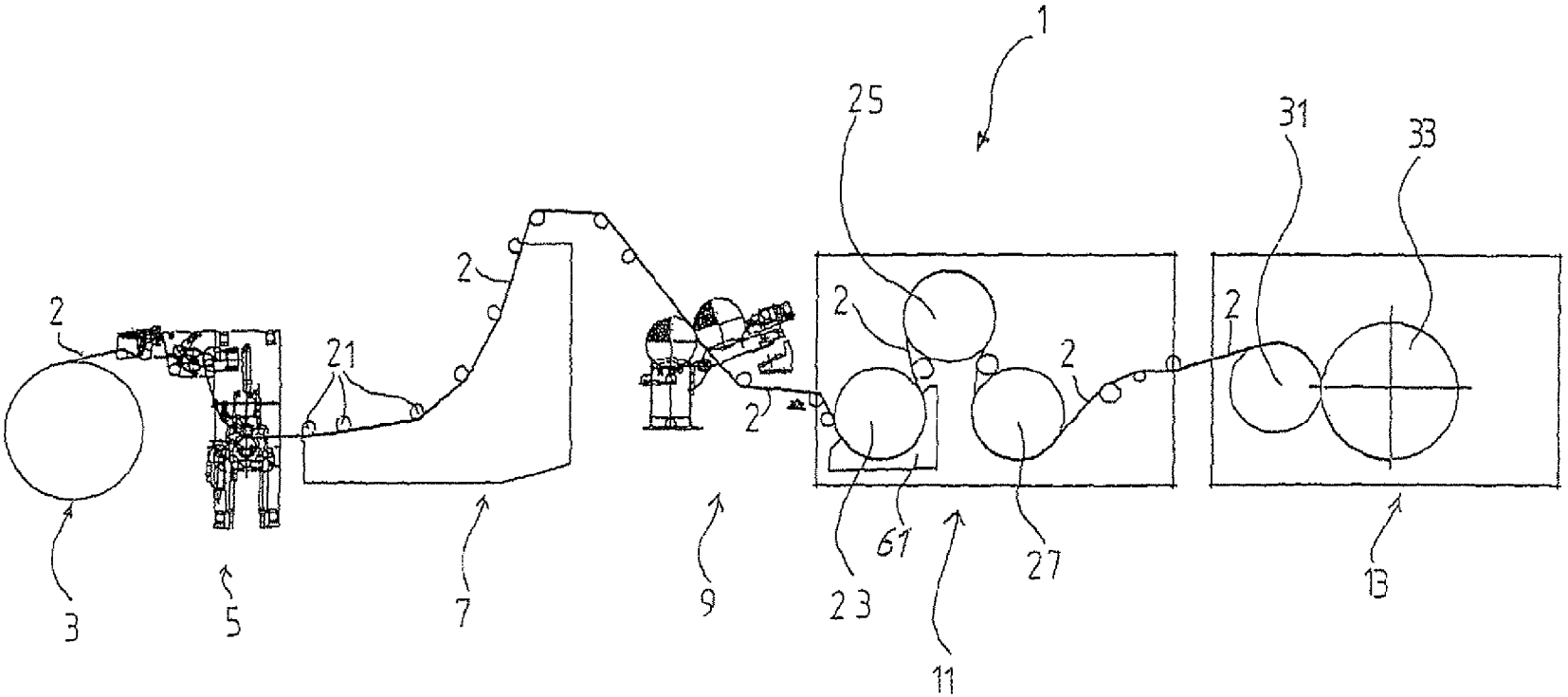

(51) Int. Cl.

| | |
|---|---|
| ***B41F 17/22*** | (2006.01) |
| ***B05D 1/02*** | (2006.01) |
| ***D21F 5/00*** | (2006.01) |
| ***D21F 9/00*** | (2006.01) |
| ***D21F 11/00*** | (2006.01) |
| ***D21G 7/00*** | (2006.01) |
| ***A24C 5/38*** | (2006.01) |
| *B41F 17/26* | (2006.01) |
| *B41F 17/16* | (2006.01) |
| *B41F 17/30* | (2006.01) |

(52) U.S. Cl.
CPC *D21F 11/00* (2013.01); *D21G 7/00* (2013.01); *B41F 17/006* (2013.01); *B41F 17/16* (2013.01); *B41F 17/26* (2013.01); *B41F 17/30* (2013.01)

(56) References Cited

U.S. PATENT DOCUMENTS

| | | | | |
|---|---|---|---|---|
| 4,340,074 | A | 7/1982 | Tudor | |
| 5,303,440 | A | 4/1994 | Zimmer | |
| 5,365,814 | A | 11/1994 | Irikura | |
| 5,706,834 | A | 1/1998 | Meiring | |
| 6,198,537 | B1 * | 3/2001 | Bokelman et al. | 356/429 |
| 6,368,459 | B1 | 4/2002 | Kinnunen | |
| 7,047,982 | B2 | 5/2006 | Seymour | |
| 2002/0129824 | A1 | 9/2002 | Hammersmith | |
| 2008/0029111 | A1 | 2/2008 | Dube | |
| 2008/0101836 | A1 | 5/2008 | Fujita | |
| 2008/0202368 | A1 | 8/2008 | Kajitani | |
| 2008/0236774 | A1 | 10/2008 | Henssler | |

FOREIGN PATENT DOCUMENTS

| | | | |
|---|---|---|---|
| DE | 90308 | | 5/1972 |
| DE | 102006028420 | A1 | 12/2007 |
| EP | 0486213 | A1 | 5/1992 |
| EP | 2425056 | A | 11/2010 |
| JP | 62-183348 | | 8/1987 |
| JP | S 63297812 | A | 12/1988 |
| JP | 05-008372 | | 1/1993 |
| JP | 05272087 | | 10/1993 |
| JP | 07229095 | | 8/1995 |
| JP | 2004-299228 | | 10/2004 |
| JP | 4857104 | B2 | 1/2012 |
| WO | WO 2004047572 | A1 | 6/2004 |
| WO | WO 2007/046124 | A1 | 4/2007 |
| WO | WO 2008146158 | A2 | 12/2008 |

OTHER PUBLICATIONS

European Patent Office, Communication from European Patent Office for European Patent Application No. 10719264.3-2314 dated Oct. 9, 2012, 9 pages.

European Patent Office, European Office Action for European Patent Application No. 10 719 264.3 dated Oct. 18, 2012, 4 pages.

European Patent Office, International Application No. PCT/EP2010/002665 English Translation and original of International Search Report and Written Opinion dated Aug. 5, 2010, 16 pages.

* cited by examiner

INSTALLATION FOR PROCESSING A PAPER WEB, IN PARTICULAR A CIGARETTE PAPER WEB

This application is a Continuation of U.S. application Ser. No. 13/266,504, filed Oct. 27, 2011 under the provisions of 35 U.S.C. §371 and claiming the priority of International Patent Application No. PCT/EP/2010/002665 filed on Apr. 30, 2010, entitled "ARRANGEMENT AND METHOD FOR PROCESSING A PAPER WEB, IN PARTICULAR A CIGARETTE PAPER WEB" in the name of Franz BURGER, which claims priority of German Patent Application No. DE102009019600.5 filed on Apr. 30, 2009, the contents of all of which are hereby incorporated by reference herein in their entirety.

The invention relates to an installation, respectively a method for processing a paper web with a basis weight not exceeding 70 or 60 g/m$^2$, in particular not exceeding 50 g/m$^2$, in particular a cigarette paper web. For example, a web of cigarette paper of a basis weight of 20 to 40 g/m$^2$ may be considered. Commonly, the cigarette paper contains a filler, in particular calcium carbonate, to ensure sufficient opacity of the cigarette paper.

There is a need in the cigarette industry to modify the cigarette paper at its surface for smoldering and ignition safety. In a so-called low ignition propensity (LIP) cigarette paper clearly delimited zones are to be realized on the cigarette paper where the air permeability is reduced down to a measure that causes a cigarette to extinguish as soon as it is put onto a firm surface and the glowing cone has reached such a zone. This kind of smoldering protection is realized for example in that a starch solution or suspension is applied to an inner side of the cigarette paper web, that is the side of the cigarette paper facing the tobacco, commonly in bands perpendicular to the conveying direction. The inventors of the subject of application have realized that residual stresses and changes in elongation of the paper occur over the paper web between printed and unprinted areas, that is between areas treated with a starch solution/suspension band and areas free of starch solution/suspension, which stresses may even produce creases in the cigarette paper. The formation of creases in the cigarette paper poses on the one hand problems for further processing of the cigarette paper and on the other hand is accompanied by an optical deficit reducing the acceptance of the smoking article produced from this paper by the consumer, thereby posing an economic disadvantage. The printed cigarette paper is usually cut subsequent to its treatment with the starch solution/suspension. The maximum throughput of cigarette paper manufacturing is limited especially by the cutting station, wherein only very low feeding speeds not exceeding 50 m/min may be used, in particular owing to the mechanical properties of the cigarette paper resulting from the bands of starch solution/suspension.

It is an object of the invention to overcome the disadvantages of the state of the art, in particular to provide an installation as well as a method for processing a paper web with a basis weight not exceeding 60 or 70 g/m$^2$, in particular not exceeding 50 g/m$^2$ with which paper can be processed in large quantities, wherein a treatment of the paper, for example for smoldering protection, does not lead to an optical impairment of the cigarette paper and wherein the mechanical properties of a treated cigarette paper are improved for a higher production speed.

Accordingly, an installation is provided for processing a paper web with a basis weight not exceeding 60 or 70 g/m$^2$, in particular not exceeding 50 g/m$^2$, in particular a cigarette paper web, the installation having an input side via which the paper web can be fed to the installation. Furthermore, the installation has an output side via which the paper web leaves the installation, wherein the paper web runs through the installation from the input side to the output side, in particular continuously with preferably essentially constant conveying speed in a conveying direction. According to the invention, a device, in particular a printing unit, preferably a gravure printing unit is disposed downstream of the input side, intended to apply a liquid print medium like a starch solution or suspension in particular for forming a smoldering protection, onto the paper web, that is onto one side of the paper web. A first drying station, in particular a hot air dryer follows the printing unit in conveying direction, the dryer being intended to dry the print medium applied to the paper web. If at this position, processing of the paper by the installation or method according to the invention was terminated, then the paper web would be weakened in particular in the transit area between print medium free and print medium containing paper sections owing to structural changes and warping of the paper and the resulting changes of mechanical properties like the elongation of the paper, which is optically recognizable by the formation of creases in the transition zone.

Insofar the invention proposes a device for humidifying the paper web following the first drying station in order to humidify the paper web which at that stage contains the dried print medium, wherein a second drying station is disposed downstream the humidifying station in conveying direction, by means of which the humidified paper web is to be dried again.

The device for applying the medium can comprise a printing unit, like a gravure printing unit. An alternative technique for applying the medium, like a film pressing technique is also conceivable.

Thus, according to the invention, the printed cigarette paper, usually being afflicted by the formation of creases, shall be smoothed by a complete humidification and a subsequent drying. Unexpectedly, it became apparent that the quality of the paper web does not suffer a deterioration from the humidification and subsequent drying. In contrast, areas with creases between paper sections containing print medium can be smoothed out without causing warping and stresses at the paper web. With the method and apparatus according to the invention also complex image structures like pictorial marks, etc. can be printed on paper without unwanted creases being formed.

In a preferred embodiment of the invention, the printing unit is designed to print the pattern with alternating areas containing print medium and not containing print medium. Therein, in particular a stripe-pattern may be used.

In a further development of the invention the print medium is a water-based solution, an emulsion or a suspension, preferably a starch solution or suspension.

Preferably, the printing unit is designed as a gravure printing unit and has an impression cylinder and a printing cylinder that cooperates with the impression cylinder according to the printing process. The printing cylinder can be associated with a basin containing the print medium such that upon rotation of the printing cylinder the latter is covered by the liquid print medium in order to apply the print medium to the paper web during its passage through a pressure contact area between the printing cylinder and the impression cylinder. Therein, the basin may consist of two sections, that is an inner basin and an outer basin. Depending on the diameter of the printing cylinder, the inner or the outer basin is used. The inner basin has a smaller diameter or smaller dimensions compared to the outer basin. When using printing cylinders with a small diameter it is advantageous to use the smaller inner basin. In this way, a better scooping behavior of the cylinder is achieved. For cylinders with a diameter exceeding about 750 mm the inner basin is too small.

In a preferred embodiment of the invention, the print cylinder has an external circumference of 400 to 1200 mm.

In a further development of the invention, the hot air drying is effectuated contactless with respect to a printed side of the paper web. This may include conveyor rolls that can also be in direct contact with the paper web wherein, however, the conveyor rollers shall not fulfill a drying function but merely a conveying function and shall be in contact with the paper web only at the unprinted side. The transport of the paper through the hot air drying may also be realized via a support web. This web is driven by conveyor rollers. The web is in direct contact with the paper but never in contact with its printed side.

The hot air drying can be realized by a stream surrounding the paper web, wherein the circulating airstream shall have a temperature not exceeding 240° C.

In a further development of the invention the humidification device is designed to humidify the entire paper web during its passage through the humidification device. This can imply that the humidification device realizes a wetting or humidification of the paper web along its complete width during its passage through the humidification device, wherein all sections of the paper web are respectively humidified during the transport of the paper web in longitudinal direction, in particular one-sided or two-sided.

Preferably, the humidification device humidifies the paper web with an impregnation liquid that may have a temperature of 15° C. to 75° C.

In a preferred embodiment of the invention, the humidifying device forms a sump of impregnation liquid through which the paper web is guided or drawn for its humidification.

Preferably, the humidification device has two rollers that are rotatably mounted such that they can be pressed against each other. Therein, a sump of impregnation liquid is formed at a pressure contact area between the rollers. Preferably the rollers shall be pressed against each other with a pressure not exceeding 3.5 bar.

In a preferred embodiment of the invention, the humidification device has a pump for forming the sump of impregnation liquid capable of conveying the impregnation liquid into the press contact area of the rollers. Therein, the pump can be connected to a tubular duct guiding the pump impregnation liquid up to the pressed contact area of the two rollers.

In a preferred embodiment of the invention, the surface of the at least one roller is provided with a coating material like ceramics or polytetrafluoroethylene. Other coating materials may be used that have in particular a low friction resistance, a homogenous surface structure, an extreme temperature resistance and a good chemical resistance and are not adhesive.

In a further development of the invention, the humidification device consists of a spraying apparatus for spraying the paper web with the impregnation liquid. Thus, the humidification may be also be realized by pulverizing the impregnation liquid through nozzles, wherein the liquid reaches the paper web only in this way. The spraying apparatus can be provided also additionally to the above-named sump arrangement where the paper web is exposed to the liquid impregnation agent. The sump humidification and the spraying apparatus may be operated independently from each other or at the same time.

Preferably, the spraying apparatus is downstream of the rollers in conveying direction so that in case that a sump area is provided in the press contact area of the rollers, the paper web prehumidified by the sump can be covered with liquid additionally through the spraying apparatus in particular from both sides. Therein, the spraying apparatus may be a tube formed with nozzles that are arranged widthwise across the paper web such that the paper web is completely humidified when it has passed the humidification device.

In a preferred embodiment of the invention, a control unit is provided in the installation capable of adjusting in particular a spraying pressure and/or spraying quantity of the humidification device. Therein the control unit can act on the nozzle of the tube in a controlling manner.

Alternatively or additionally the humidification device can be designed as a gravure printing unit that completely humidifies the paper web.

In a preferred embodiment of the invention, the impregnation liquid is water, a water-based solution, an emulsion or a suspension of water soluble or water insoluble inorganic or organic compounds. The water-based composition can comprise salts, in particular citrates for adjusting the smoldering speed.

A further alternative possibility to provide complete humidification of the paper web can be realized by using a gravure printing unit or a size press.

In the apparatus as well as for the method according to the invention it is preferably to be assured that the applied quantity of water amounts at least to 10% of the dry paper mass. Preferably the applied proportion of water is between 25% and 50%. It is also possible to apply a water amount of 100%. As a basic rule for the adjustment of the amount of the applied impregnation liquid it can be stated that the larger the amount of print medium applied in the first station, the more the paper web is to be humidified with impregnation liquid. Preferably, water with a temperature between 10° C. and 80° C. is to be used as impregnation or humidification liquid. Preferably, the temperature of the water should be about 25° C. to 40° C. In such a temperature range the subsequent drying is facilitated, wherein additionally it was found surprisingly that warmer water of at least 40° C. used for the humidification even improves the penetration into the paper structure of the print medium applied in the printing area, resulting in a reduced necessity of water for the humidification.

In a preferred embodiment of the invention, the second drying station is realized by contact drying in which the humidified paper web is in direct contact with at least one heated drying cylinder or roller, preferably three or four drying cylinders. Therein, heat is transmitted to the paper web through contact with the drying cylinders in order to achieve dehumidification of the paper web and thus drying of the paper web. At the same time, the paper web is put under tensile stress within the drying station in such a way that the paper web is snugly resting on the drying cylinders, whereby a simultaneous drying and smoothing is achieved.

Preferably, a hot air drying hood is provided at least one drying cylinder, in particular at the first drying cylinder in conveying direction, the drying hood surrounding the drying cylinder at least partially such that the paper web is exposed to a drying stream of hot air on the drying cylinder, the stream being guided by the inside of the hood.

Therein a circumferential wall of the drying cylinder on which the paper web is resting can have a temperature of at least about 60° C. and at most about 180° C.

In a preferred embodiment of the invention the at least one drying roller is cylindrical and has in particular a cylindrical outer contact area. Around the cylindrical outer contact area the drying of the humidified paper web occurs as the latter is resting snugly on a circumferential range of the cylindrical outer contact area. The circumferential range that is covered by the paper web is preferably larger than 90° C., 100° C., 110° C. or 120° C., in particular larger than 180° C. at least for a drying roller.

Preferably the cylindrical outer contact area is smooth and free of protrusions. In this way, an ironing effect of the humidified paper web is achieved. Therein, it is assured that contact with the drying cylinder is achieved over the complete width of the paper web within the circumferential range. Thus, the outer contact area is pattern free.

In a further development of the invention, at least three drying rollers are provided that are offset with respect to each other in a vertical direction. Therein, for example the first and the last drying roller may be disposed at the same horizontal height. The drying rollers adjacent in horizontal direction may partially intersect in vertical direction so that the paper web is running backwards against the conveying direction after passing from a first drying roller to a second drying roller and from there to a third drying roller.

Preferably, the at least one cylindrical drying roller has a diameter of at least 80 cm, preferably smaller than 2.5 m, wherein a preferred diameter dimension is 1.8 m. The at least one drying roller comprises an in particular closed hollow space that can be filled with steam or hot air in order to heat the drying roller. Alternatively, the drying roller may be heated through infrared radiation.

A particular aspect according to the invention consists in providing a predetermined temperature pattern at the at least two drying rollers.

Commonly, it would be expected that the temperature of the drying rollers increases in transport direction of the paper web from one drying roller to the next drying roller. According to the invention, the temperature pattern from one drying roller to another drying roller in transport direction is adjusted such that the temperature remains at least equal or decreases from the first drying roller at the input side to the second drying roller. Therein, initially the unprinted side of the paper web may enter into contact with the first drying roller at the input side and thereby be dried. On the subsequently following second drying roller the printed side of the paper web is then in contact with the roller. If now at the second drying roller an elevated temperature was present, it could possibly occur that the print medium sticks onto the drying roller at the printed areas of the paper web. This kind of sticking or thermal reaction of the printed medium is avoided by the reduced temperature at the second drying roller. The temperature of the third drying roller is subsequently adjusted higher than the one of the second drying roller in order to improve the drying efficiency as again the unprinted side of the paper web enters into contact with the drying surface of the third drying roller. Should a fourth drying roller be provided in the drying station, the temperature is to be adjusted such that it is significantly reduced in order to avoid the above-mentioned thermal reaction of the print medium. For example, the temperature pattern between three drying rollers may be arranged as follows:

first drying roller: 100° C.;

second drying roller: 95° C.;

third drying roller: 120° C.

In case that the contents of solid matter of the print medium is higher, for example larger than 25% solid matter (less than 75% solvent), the following temperature pattern in transport direction may be provided for the drying cylinders:

first drying cylinder: 95° C.;

second drying cylinder: 95° C.;

third drying cylinder: 110° C.

Thus, in this embodiment it is possible to at least equalize the first drying cylinder temperature and the second drying cylinder temperature, wherein the third drying cylinder temperature, at which the unprinted side of the paper web is in contact with the drying cylinder, is significantly raised.

Generally it is to be noted that the temperatures at the outside of the drying cylinder should not exceed 150° C., as otherwise a discoloration of the paper web may occur. However, in order to achieve a sufficient drying effect, a minimum temperature of 60° C. should be used.

In a preferred embodiment of the invention a reeling up roller is provided at the output side, the roller being rotatingly driven such that the paper web is under tension at least during its transport through the second drying station. Besides, an unreeling roller with a reeled up paper web roll can be provided at the input side where tensions and/or irregularities of the unreeling roller can be compensated by a spring-tightened pendulum system. The pendulum system can preferably also be pretightened by means of compressed air and controlled to perform a respective pendulum movement.

As indicated above, the invention also relates to a method for processing a paper web with a basis weight of 60 or 70 g/m$^2$, in particular not exceeding 50 g/m$^2$, in particular of a cigarette paper web, wherein a liquid medium like a print medium is applied to the paper web, in particular at a printing unit, in particular a gravure printing unit. Subsequently, the print medium applied to the paper web is dried, in particular at a first drying station, in particular at a hot air dryer. Subsequently, the paper web is humidified with a liquid impregnation medium and the humidified paper web is dried, in particular at a second drying station.

It shall be understood that the method according to the invention may proceed according to the functionality of the above named installation according to the invention.

Figure 2:
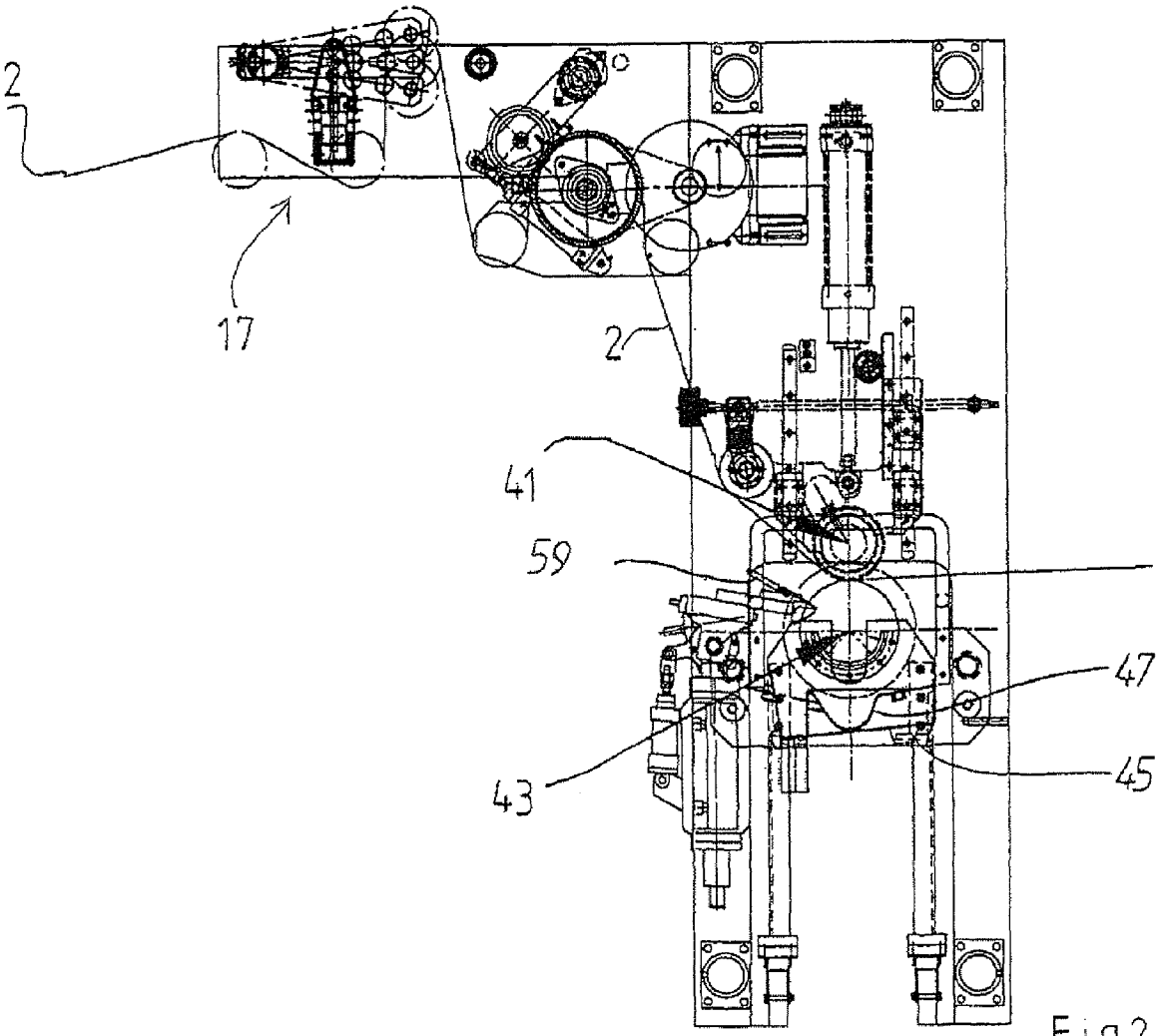
Figure 3:
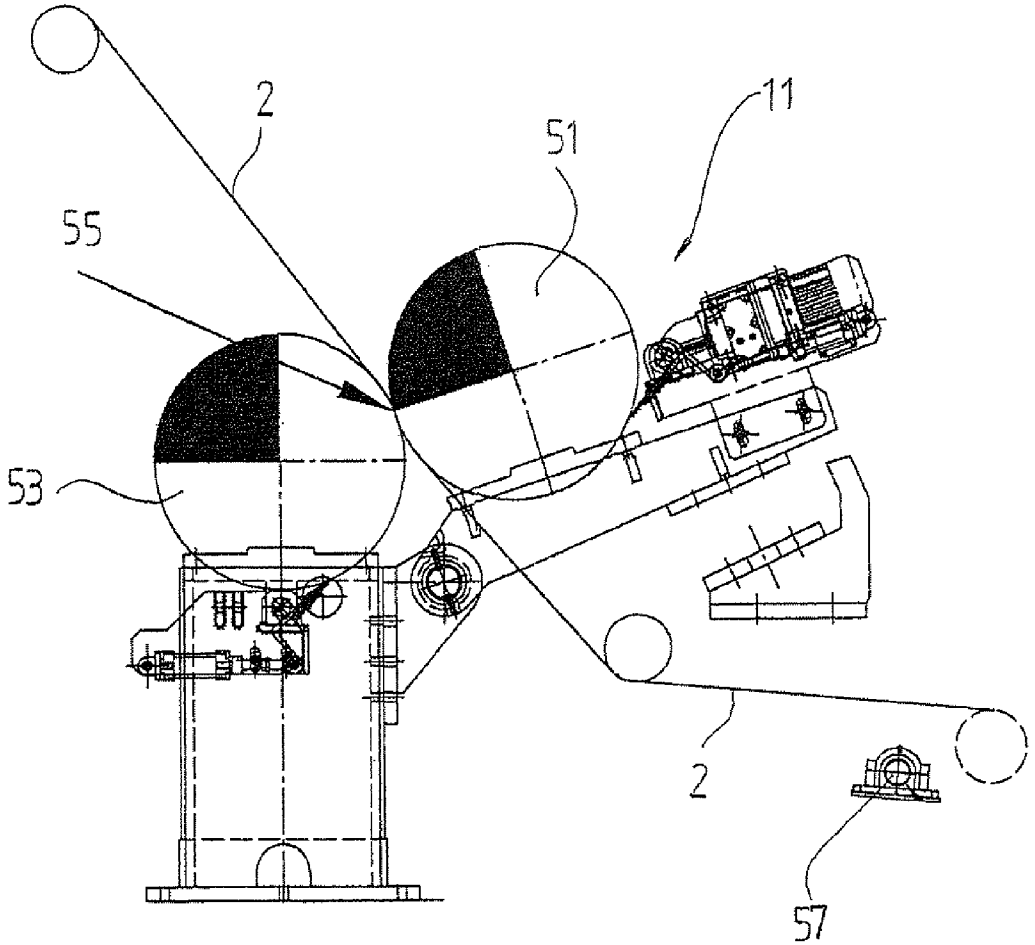

Further characteristics, advantages and features of the invention will become apparent through the following description of a preferred embodiment of the invention in conjunction with the attached drawings, showing:

FIG. 1 a schematic lateral view of the installation according to the invention;

FIG. 2 a schematic detailed view of a printing unit of the installation according to the invention; and FIG. 3 a schematic detailed view of a humidification device of the installation according to the invention.

FIG. 1 shows the installation according to the invention for processing a cigarette paper web 2 with a basis weight of 24 g/m$^2$ to 32 g/m$^2$, generally given the reference numeral 1. The paper processing installation 1 comprises the following essentially necessary main stations: an unreeling station 3, a gravure printing unit 5, a hot air dryer 7, a humidifying device 9, a contact dryer 11 as well as a reeling up station 13.

The unreeling station 3 comprises a sleeve (not represented in detail) having an internal diameter of about 76 mm from which the paper web 2 is reeled off. Different dimensions of the internal sleeve diameter, such as for example 120 mm may also be used. The sleeve is rotatably mounted or may be attached to a respectively rotating shaft. Alternatively, the paper roll may be reeled onto a steel core that is suspended in an unreeling device of the unreeling station. In order to level out stresses or inconstancies of the paper web 2, a pendulum system 17 may be provided directly at the reeling off station 3, the pendulum system being pretensioned with compressed air in order to communicate a respective pulling preload to the paper web 2. As shown in FIG. 2, the pendulum system 17 is part of the gravure printing unit 5.

At the gravure printing unit 5 the paper web 2 is wetted in bands or stripes with a desired starch solution/suspension on one side by printing the starch solution/suspension with the help of the gravure printing method onto one side of the paper web. The functionality of the gravure printing unit 5 will be explained later referring to FIG. 2.

The hot air dryer 7 is disposed directly after the gravure printing unit 5, having a drying length of about 3.25 m. The hot air dryer 7 is designed to generate a heated surrounding air stream with a flow speed of 17000 $m^3$/h at a temperature not exceeding 240° C. The hot air dryer 7 serves the purpose of removing solvents possibly introduced with the print medium in the gravure printing unit 5. In order to go easy on the paper web 2 it is transported through the hot air dryer 7 over a piece of felt. Therein, the paper rests on the unprinted side of the paper, wherein the printed side is not in contact with components of the hot air dryer during the drying procedure. The paper web is transported via a transport belt that is for example made of felt and driven via guiding rollers 21.

Directly after the hot air dryer 7 a humidification device 9 is disposed, shown in detail in FIG. 3, which will be explained in detail later. The humidification device 9 is intended to humidify the paper web 2 across its whole width and length with a liquid impregnation medium. Water, a water-based solution, emulsion or suspension at a temperature of 15 to 75° C. may be used as an impregnation medium. The humidification device 9 can form a sump that is for example to be formed between two rollers pressed against each other, one of which is exposed to the impregnation medium. As the paper web 2 is transported through the contact area, it is exposed to the impregnation liquid via the sump.

Subsequently, the humidified paper web 2 is fed to a contact dryer 11 that consists, as evident in FIG. 1, essentially of three drying cylinders or rollers 23, 25 and 27 having the same diameter. The drying cylinders 23, 25, 27 are exposed to vapor, in particular steam and can be heated up to a temperature not exceeding 120° C. The contact dryer 11 serves the purpose to remove the liquid portion of the impregnation medium, introduced at the humidification device 9 from the paper web 2. Therein, the paper web 2 shall be in direct contact with the drying cylinders 23, 25, 27 in order to achieve a desired smoothing effect so that a completely crease-free paper web 2 is realized.

Therein, the track arrangement of the contact dryer 11 is preferably designed such that the printed side of the paper enters into contact with a drying cylinder only at the second drying cylinder 25. The first drying cylinder is thus not in contact with the printed side with the paper web, but with the opposite side. This arrangement is advantageous insofar as it does not entail sticking of the printed substances at the surface of the drying cylinder 23. For increasing the drying performance at the first drying cylinder 23, the latter is additionally fitted with a hot air hood 61 ($T_{(max.)}$=250° C.; $V_{(air\ max.)}$=12000 $m^3$/h). Thus, the paper is once dried via contact with the drying cylinder as well as smoothed, and additionally in particular the printed material is dried via the hot air of the drying hood.

The drying cylinders 23 to 27 each have one cylindrical outer contact surface that is to a large part covered and in contact with the humidified paper web 2. Preferably, the circumferential range of the drying cylinders 23 to 27 covered by the paper web is larger than 90° C., 100° C. or 120° C. For the second drying cylinder 25, the circumferential cover is larger than 180° C.

As evident from FIG. 1, three drying cylinders 23 to 27 are provided, being offset with respect to each other in vertical direction. Therein, a horizontal distance of the first 23 and third 27 drying cylinder is adjusted such that it is smaller than the diameter of the (intermediate) drying cylinder 25. This entails a partial intersection of the drying cylinders 23 to 25 seen in vertical direction so that a backward transport of the paper web 2 against the conveying direction occurs during the passage of the paper web 2 from the first drying cylinder 23 to the second drying cylinder 25 and from the second drying cylinder 25 to the third drying cylinder 27.

The paper web is preloaded with tensile stress within the drying station 11 in order to rest evenly around the outer contact surfaces of the drying cylinders 23 to 27.

A reeling up station 13 is disposed directly after the contact dryer 11 comprising a support cylinder 31 and a reeling up roller 33. The function of the support cylinder 31 is to apply the necessary tension to the paper web 2 in order to assure a flawless reeling up of the paper web 2 at the reeling up roller 33.

In the following the gravure printing unit 5 is explained in detail referring to FIG. 2.

After the paper web 2 is subjected to tensile stress by the pendulum system 17 the paper web 2 is fed to an arrangement consisting of an impression cylinder 45 and a printing cylinder 43 covered with a liquid print medium (not shown in detail). The wetting of the printing cylinder 43 is achieved in that during its rotation around its axis the printing cylinder 43 is running through a basin containing the printing liquid. The basin can be formed by two sections that is an outer basin 45 and an inner basin 47 having a smaller volume compared to the outer basin. When printing cylinder 43 with a small diameter is used, it is advantageous to use the inner basin 47 in order to achieve a better scooping behavior of the print cylinder 43. The impression cylinder builds up the necessary mechanical pressure in order to cause the print medium to be transferred from the printing cylinder 43 to the paper web 2. Additionally, the impression cylinder 41 assures the transport of the paper web 2 through the gravure printing unit 5. A squeegee 59 is provided in vicinity of the printing cylinder 43 in order to swipe off excess print medium from the printing cylinder 43. The paper web 2 leaves the gravure printing unit 5 towards the hot air dryer 7.

In FIG. 3, the humidifying device 11 is represented in detail, consisting essentially of two rollers 51, 53 that define a contact pressure area 55 through which the paper web 2 is squeezed. A sump of impregnation liquid is formed in the contact pressure area 55 by means of a pump not shown in detail in order to cover the complete paper web 2 with the impregnation liquid.

Alternatively or optionally, in addition to the sump formation at the contact pressure area 55 a spraying tube 57 may be provided directly thereafter, arranged either at one side of the paper web 2 or on both sides (not represented). The spraying tube 57 has several nozzles off which the impregnation liquid is sprayed onto the paper web 2 in order to realize a complete cover of the paper web 2 with impregnation liquid.

Subsequently, the humidified paper web 2 leaves the humidifying device 11 for its drying and smoothing in the contact dryer 11.

Surprisingly, it became apparent that following the contact drying the paper did not exhibit any creases and that the mechanical properties like the elongation of the paper web 2 could be clearly improved so that distinctly higher feeding speeds could be achieved in the subsequent cutting installations. Owing to the impregnation in the humidifying device and the contact drying in the contact dryer the paper printed by the gravure printing method can be processed as if it had not been printed on.

The features disclosed in the above description, the figures and the claims can be relevant for the realization of the invention in its different embodiments individually as well as in any combination.

LIST OF REFERENCE NUMERALS

1 paper processing installation
2 cigarette paper web
3 reeling off station
5 gravure printing unit
7 hot air dryer
9 humidification device
11 contact dryer
13 rolling up station
17 pendulum system
21 guiding rollers
23, 25, 27 drying cylinders
31 support cylinder
33 reeling up roller
41 impression cylinder
43 printing cylinder
45 outer basin
47 inner basin
51, 53 rollers
55 contact pressure area
57 spraying tube
59 squeegee
61 hot air hood

What is claimed is:

1. An installation for processing a cigarette paper web with a basis weight not exceeding 70 g/m$^2$, the installation comprising:

an input side, via which the paper web is fed to the installation;

an output side via which the paper web leaves the installation, wherein the paper web runs through the installation from the input side to the output side in a conveying direction;

an applying device downstream of the input side for applying a liquid print medium onto the paper web to provide a printed side of the paper web;

a first drying station following the applying device in the conveying direction for drying the print medium applied to the paper web;

a humidification device for humidifying the paper web following the first drying station in the conveying direction; and a second drying station following the humidification device in the conveying direction, by means of which the humidified paper web is dried, wherein the second drying station uses contact drying, in which the humidified paper web is in direct contact with at least one heated drying roller including a first heated drying roller in the second drying station being the first drying roller in the conveying direction in the second drying station, and wherein the first heated drying roller is not in contact with the printed side of the paper web.

2. The installation according to claim 1, in which the first drying station works contactless with respect to a printed side of the paper web.

3. The installation according to claim 1, in which the first drying station has a conveyor belt like a sieve that is driven via conveyor rollers, which conveyor belt is in contact with in particular only an unprinted side of the paper web and conveys the paper web through the first drying station.

4. The installation according to claim 1, in which the first drying station is a hot air drying station which generates an air stream surrounding the paper web and having a temperature not exceeding 240° C.

5. The installation according to claim 1, in which the humidification device humidifies the paper web with an impregnation liquid having a temperature of 40° C. to 75° C.

6. The installation according to claim 1, in which the humidification device has two rollers that are rotatably mounted such that they are pressed against each other, wherein a sump of impregnation liquid is formed at a pressure contact area of the rollers.

7. The installation according to claim 6, in which the rollers can be pressed against each other with a pressure not exceeding 3.5 bar.

8. The installation according to claim 6, in which the surface of at least one roller is coated with a material selected from the group comprising ceramic or polytetrafluoroethylene.

9. The installation according to claim 1, in which the humidification device has a spraying apparatus for spraying the paper web with a impregnation liquid.

10. The installation according to claim 9, in which the spraying apparatus is downstream of rollers of the humidification device in the conveying direction.

11. The installation according to claim 9, in which the spraying apparatus is formed by a tube fitted with nozzles that is arranged extending in cross direction of the paper web such that the paper web is completely humidified.

12. The installation according to claim 9, in which spraying pressure, spraying amount, or a combination thereof is adjustable through a control device.

13. The installation according to claim 1, in which a circumferential wall of the drying roller, on which the paper web resting, is heated to a temperature not exceeding 180° C.

14. The installation according to claim 1, in which at least three drying rollers are provided that are offset in a vertical direction, wherein the drying rollers subsequent to each other in the conveying direction are partially intersecting seen in the vertical direction.

15. The installation according to claim 1, in which a reeling up roller is provided at the output side, the reeling up roller being rotationally driven such that the paper web is pretensioned at least during its transport through the second drying station.

16. The installation according to claim 1, in which an unreeling roller with a wound-up paper web is disposed at the input side, wherein inconstancies of the paper web are compensated at the unreeling roller by a pendulum system pretensioned by means of compressed air.

17. The installation according to claim 1, wherein the at least one heated drying roller comprises at least two heated drying rollers in a series, and the first heated drying roller in the series has a higher temperature than the adjacent second heated drying roller in the series.

18. A method for processing a cigarette paper web with a basis weight not exceeding 70 g/m$^2$, the method comprising:

applying a liquid print medium to the paper web at a printing unit to provide a printed side of the paper web;

drying the liquid print medium at a first drying station;

humidifying the paper web with a liquid impregnation medium; and drying the humidified paper web at a second drying station using contact drying, wherein the humidified paper web is brought into direct contact with at least one heated drying roller including a first heated drying roller in the second drying station being the first drying roller in the conveying direction in the second drying station, and wherein the first heated drying roller is not brought into contact with the printed side of the paper web.

19. The method of claim 18, wherein the at least one heated drying roller comprises at least two heated drying rollers in a series, further comprising controlling the first heated drying roller in the series to have a higher temperature than the adjacent second heated drying roller in the series.

20. The method of claim 18, wherein the at least one heated drying roller comprises at least three heated drying rollers in a series, further comprising controlling the first heated drying roller and the third heated drying roller in the series to have a higher temperature than the second heated drying roller in the series which is operationally disposed between the first heated drying roller and the third heated drying roller.

* * * * *